US012096852B2

(12) United States Patent
Sutterluetti

(10) Patent No.: US 12,096,852 B2
(45) Date of Patent: Sep. 24, 2024

(54) PULL-OUT GUIDE FOR A MOVABLE FURNITURE PART

(71) Applicant: Julius Blum GmbH, Hoechst (AT)

(72) Inventor: Harald Sutterluetti, Fussach (AT)

(73) Assignee: JULIUS BLUM GMBH, Hoechst (AT)

( * ) Notice: Subject to any disclaimer, the term of this patent is extended or adjusted under 35 U.S.C. 154(b) by 102 days.

(21) Appl. No.: 17/977,579

(22) Filed: Oct. 31, 2022

(65) Prior Publication Data

US 2023/0059249 A1 Feb. 23, 2023

Related U.S. Application Data

(63) Continuation of application No. PCT/AT2021/060137, filed on Apr. 22, 2021.

(30) Foreign Application Priority Data

May 7, 2020 (AT) ..... A 50388/2020

(51) Int. Cl.
*A47B 88/407* (2017.01)
*A47B 88/00* (2017.01)
(Continued)

(52) U.S. Cl.
CPC ..... *A47B 88/407* (2017.01); *A47B 88/453* (2017.01); *A47B 88/463* (2017.01);
(Continued)

(58) Field of Classification Search
CPC ... A47B 88/407; A47B 88/453; A47B 88/463; A47B 88/483; A47B 88/477;
(Continued)

(56) References Cited

U.S. PATENT DOCUMENTS 7,883,162 B2 2/2011 Langguth et al.
7,920,373 B2 4/2011 Matsubara
(Continued)

FOREIGN PATENT DOCUMENTS

AT 512748 4/2017
CN 103442618 12/2013
(Continued)

OTHER PUBLICATIONS

International Search Report issued Jul. 20, 2021 in International (PCT) Application No. PCT/AT2021/060137.

*Primary Examiner* — Kimberley S Wright
(74) *Attorney, Agent, or Firm* — Wenderoth, Lind & Ponack, L.L.P.

(57) ABSTRACT

A pull-out guide includes a carcass rail, a drawer rail movable along a longitudinal axis in an opening and closing direction of a movable furniture part, a drive apparatus for moving the drawer rail and the movable furniture part between a closed position and an open position, and a depth adjustment device for adjusting the closed position of the drawer rail relative to the carcass rail. The depth adjustment device has a carrier, a stop element movable relative to the carrier, and a depth adjustment wheel mounted rotatably about a rotation axis on the carrier for moving the stop element along the longitudinal axis. The rotation axis of the depth adjustment wheel is parallel to the longitudinal axis, and the stop element contacts a stop-counterpart piece of the drive apparatus in the closed position and is releasable by the stop-counterpart piece.

21 Claims, 20 Drawing Sheets

(51) Int. Cl.

| | |
|---|---|
| ***A47B 88/453*** | (2017.01) |
| ***A47B 88/463*** | (2017.01) |
| ***A47B 88/483*** | (2017.01) |
| *A47B 88/427* | (2017.01) |
| *A47B 88/477* | (2017.01) |

(52) U.S. Cl.
CPC ..... *A47B 88/483* (2017.01); *A47B 88/427* (2017.01); *A47B 88/477* (2017.01); *A47B 2210/0018* (2013.01); *A47B 2210/0059* (2013.01); *A47B 2220/0022* (2013.01)

(58) Field of Classification Search
CPC .... A47B 2210/0018; A47B 2210/0059; A47B 2220/0022; A47B 88/427; A47B 2210/0056; A47B 2210/0054
See application file for complete search history.

(56) References Cited

U.S. PATENT DOCUMENTS

| | | | | |
|---|---|---|---|---|
| 9,125,490 | B2 | 9/2015 | Haemmerle et al. | |
| 9,345,324 | B2 | 5/2016 | Grabherr | |
| 9,756,940 | B2 | 9/2017 | Chen et al. | |
| 9,976,331 | B2 | 5/2018 | Albrecht | |
| 10,051,962 | B2 | 8/2018 | Goetz | |
| 10,568,425 | B2 | 2/2020 | Chen et al. | |
| 10,667,607 | B2 * | 6/2020 | Chen | A47B 88/467 |
| 2007/0101539 | A1 * | 5/2007 | Sutterlutti | E05F 1/16 16/49 |
| 2009/0096337 | A1 | 4/2009 | Langguth et al. | |
| 2010/0246109 | A1 | 9/2010 | Matsubara | |
| 2011/0286689 | A1 * | 11/2011 | Liang | A47B 88/463 384/10 |
| 2013/0293078 | A1 | 11/2013 | Haemmerle et al. | |
| 2014/0015390 | A1 | 1/2014 | Grabherr | |
| 2014/0300262 | A1 * | 10/2014 | Flogaus | A47B 88/47 312/319.1 |
| 2016/0227927 | A1 | 8/2016 | Goetz | |
| 2017/0049228 | A1 | 2/2017 | Albrecht | |
| 2017/0135478 | A1 | 5/2017 | Chen et al. | |
| 2019/0216219 | A1 | 7/2019 | Chen et al. | |
| 2019/0261773 | A1 * | 8/2019 | Chen | A47B 88/477 |
| 2020/0100589 | A1 * | 4/2020 | Chen | A47B 88/427 |

FOREIGN PATENT DOCUMENTS

| | | |
|---|---|---|
| CN | 105899105 | 8/2016 |
| CN | 106466065 | 3/2017 |
| CN | 109077466 | 12/2018 |
| DE | 20 2010 013 193 | 5/2012 |
| DE | 20 2015 104 436 | 12/2016 |
| DE | 10 2016 113 116 | 1/2018 |
| DE | 10 2016 120 586 | 5/2018 |
| EP | 2 654 507 | 3/2015 |
| EP | 2 661 194 | 12/2015 |
| EP | 1 996 046 | 8/2018 |
| EP | 3 513 681 | 7/2019 |
| JP | 06-44442 | 6/1994 |
| JP | 3172038 | 3/2001 |
| JP | 3161460 | 7/2010 |
| JP | 2010-232296 | 10/2010 |
| JP | 3179942 | 10/2012 |
| JP | 2013-194472 | 9/2013 |
| JP | 2016-533805 | 11/2016 |
| JP | 2019-122748 | 7/2019 |
| TW | 201715997 | 5/2017 |

* cited by examiner

SS

SS

SS

FIG. 18
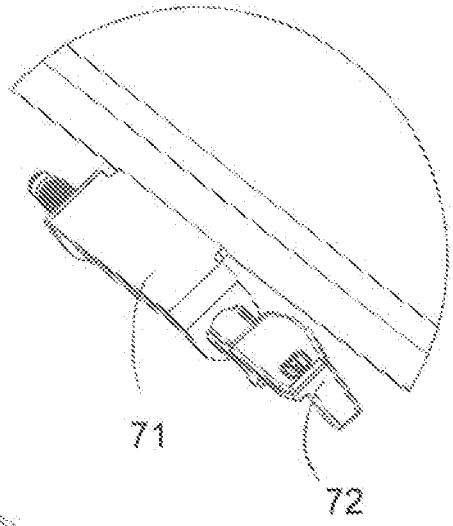
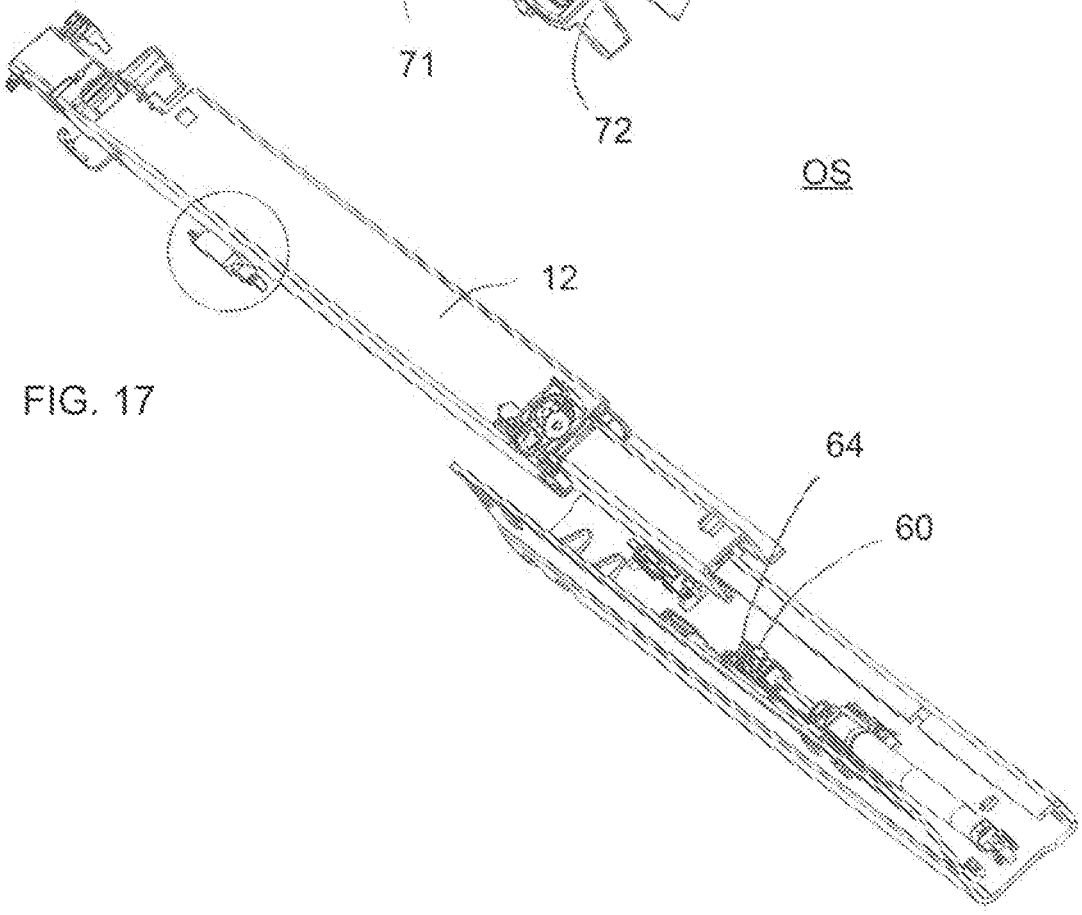
FIG. 17

PULL-OUT GUIDE FOR A MOVABLE FURNITURE PART

BACKGROUND OF THE INVENTION

The present invention relates to a pull-out guide for a furniture part that is movable relative to a furniture carcass, in particular for a drawer, having a carcass rail to be connected to the furniture carcass, a drawer rail which is mounted movably on the carcass rail and which is connectable to the movable furniture part and has a longitudinal axis. The drawer rail is movable along the longitudinal axis in an opening and closing direction of the movable furniture part, and a drive device for moving the drawer rail and the movable furniture part is connectable thereto at least in a partial range of the movement travel between a closed position and an open position. A depth adjustment device is provided for adjusting the closed position of the drawer rail relative to the carcass rail, and the depth adjustment device has a carrier, a stop element which is movable relative to the carrier along the longitudinal axis, and a depth adjustment wheel which is mounted on the carrier so as to be rotatable about an axis of rotation, for moving the stop element along the longitudinal axis. In addition, the present invention relates to a piece of furniture having a furniture carcass, a movable furniture part and such a pull-out guide.

In the case of pull-out guides, and in the case of pieces of furniture in general, it is important that, in the installed state, the individual components have the most uniform design possible and are in a regular arrangement. In particular, the furniture fronts should exhibit a uniform panel appearance. That is to say, all furniture fronts of drawers arranged next to one another or one above the other should lie in the same (vertical) plane in the respective closed position. In order to be able to achieve this in the case of pieces of furniture with installed pull-out guides, so-called depth adjustment device is provided, by means of which the relative position that exists between the carcass rail and drawer rail in the closed position (in a horizontal direction) can be varied and adjusted.

AT 512 748 B1 presents an adjusting device for adjusting a position of a drawer relative to a drawer pull-out guide, having a stop, which is movable by means of an adjustment wheel, for abutting against the drawer pull-out guide. It is therefore not the relative position between the drawer rail and carcass rail in the closed position that is adjusted here, but the relative position of the drawer with respect to the drawer rail.

No ejection device is described. In addition, the adjustment wheel rotates about an axis of rotation that is oriented transverse to the longitudinal axis of the drawer rail.

A very similar device can be found in EP 2 661 194 B1, in which prior art the setting wheel is rotatable about an axis of rotation that is oriented parallel to the longitudinal axis of the drawer rail.

By contrast, an example of a piece of furniture with a depth adjustment facility for adjusting the relative position between the drawer rail and the carcass rail can be found in DE 10 2016 120 586 A1. The described ejection device has a drive element that is subjected to force. The position of this drive element relative to a driver can be adjusted by means of a knurled nut in order to set the closed position of the movable furniture part. In the case of the described furniture fitting, the ejection device together with drive element and knurled nut is, in its entirety, either fixed to the furniture carcass or fixed to the movable furniture part. An example with ejection devices attached to the underside of the drawer at both sides is presented. A disadvantage of the variant fixed to the furniture carcass is inter alia that the knurled nut, deep within the furniture carcass, is then very awkward to reach or can scarcely be reached by hand. In the case of the variant fixed to the furniture carcass, it is disadvantageous inter alia that the ejection device takes up a relatively large amount of space on the drawer and that the entire furniture fitting (pull-out guide together with ejection device) must therefore be formed relatively wide.

The ejection device according to EP 2 654 507 B1 is of very similar design. In order to be able to adjust the gap between the front panel and the furniture carcass, an adjustment mechanism for the ejection stop is provided on the carriage, which adjustment mechanism has an adjustment travel. By rotating the nut, it is possible to move the ejection stop in a closing or opening direction. The adjustment of the panel gap can be performed when the drawer element is either open or closed, wherein the accessibility to the nut on the underside of the drawer is better when the drawer element is open. It is disadvantageous in this case, too, that the entire furniture fitting takes up a large amount of space and is relatively wide.

A similar design variant emerges from the embodiment example presented in DE 20 2015 104 436 U1, in which the ejector unit and the adjustment assembly attached to this ejector unit are attached to the underside of a drawer. Only in the description is a variant mentioned according to which the device can also be attached to guide means of the furniture part and/or to the furniture carcass. It is also mentioned with regard to the adjustment assembly that this can, independently of other elements, such as for example an ejector or a triggering means of the energy storage mechanism of the device, be formed on the piece of furniture and/or on the movable furniture part and/or on guide means of the furniture part. It is not mentioned that the adjustment assembly is formed or arranged independently of the ejector unit as a whole.

EP 1 996 046 B1 presents a device for influencing the movement of furniture parts that are movable with respect to one another. Adjusting means for the adjustment of the position of a position member on the moving rail are provided, which adjusting means are engaged by a pulling-pushing element for imparting the drive action to the furniture part. The adjusting member is fixed to an attachment element, wherein this attachment element is in turn attached to the drawer rail. By contrast, the displacement rod of the pulling-pushing element is attached via a guide profile to the base rail part (corresponds to the carcass rail). The adjusting member is thus assigned to the drawer rail, whereas the pulling-pushing element together with displacement rod (corresponds to the ejection device) is assigned to the carcass rail. In this prior art, the need for the displacement rod to be fixed to the adjusting member is a complicating factor. This is realized for example by means of a fixing screw which is screwed into an end surface of the peg and by means of which the displacement rod is prevented from being pulled out of the adjustment ring. The peg can also be pressed, welded, adhesively bonded, crimped, pinned or similarly fixed in the insertion opening. The displacement rod must therefore always participate in the entire movement travel of the drawer rail relative to the base rail part (carcass rail). The displacement rod must therefore be formed very long, which is relatively elaborate and complicated. A further disadvantage of this prior art is the difficult access to the adjusting member. Specifically, an adjustment can be performed only using a suitable tool (e.g. using a cross-head screwdriver).

SUMMARY OF THE INVENTION

The object of the present invention is to create an alternative pull-out guide to the known prior art. In particular, it is sought to, as far as possible, eliminate or avoid the disadvantages that exist in the prior art.

In the pull-out guide according to the invention, the axis of rotation of the depth adjustment wheel is oriented parallel to the longitudinal axis. The depth adjustment wheel can thus be easily actuated.

Furthermore, according to the invention, the drive device is installed on the carcass rail. In this way, the drive device can remain assigned to the furniture carcass and need not be moved jointly with the movable furniture part during the opening and closing.

According to the invention, the carrier of the depth adjustment device is installed on the drawer rail. The depth adjustment device is thus easy to reach. In particular, when the movable furniture part is open, the depth adjustment device can be easily and quickly reached by hand. The depth adjustment device is therefore not "hidden" at an inaccessible location deep within the furniture carcass.

In addition, according to the invention, the stop element, in the closed position, bears against a stop counterpart of the drive device and, during the movement travel from the closed position into an open position, can be detached from the stop counterpart.

The stop element therefore need not be permanently in contact with the stop counterpart. The stop element therefore need not participate in the entire opening and closing travel of the drawer rail. In other words, the stop element is detachably connected to the stop counterpart. Specifically, by means of this design, beyond the point at which a particular open position is reached, the stop element is spaced apart from the stop counterpart of the drive device. The stop element therefore moves jointly with the stop counterpart only in a partial range of the opening and closing travel.

For a simple development of the depth adjustment device, the stop element has a driver and a movement transmission region that is connected to the depth adjustment wheel.

The driver can be formed as a simple, as far as possible flat, stop surface. It is, however preferable that the driver is formed bolt-shaped.

Preferably, the bolt-shaped driver extends at right angles with respect to the longitudinal axis and—in the fitted state in the furniture carcass—in a vertical direction.

In order to allow a conversion of movement, preferably the movement transmission region is formed as an external thread extending in spiral fashion about the axis of rotation.

According to a preferred embodiment, the depth adjustment wheel is, at least in regions, formed in the manner of a sleeve about the axis of rotation.

Particularly preferably, the depth adjustment wheel has an internal thread extending in spiral fashion about the axis of rotation, wherein this internal thread corresponds with the external thread of the movement transmission region.

Furthermore, preferably the internal thread is formed on an inner surface, which covers an angle of at most 180° about the axis of rotation, of the depth adjustment wheel, and the depth adjustment wheel has, in that region, a recess that is situated radially opposite said inner surface. In other words, the depth adjustment wheel has a clearance (recess or opening) in the region situated radially opposite the internal thread. This clearance has the effect that, during production in an injection-molding tool, the depth adjustment wheel and its thread need not be laboriously removed by unscrewing. The demolding of the depth adjustment wheel is thus much more straightforward.

It is particularly preferable that the depth adjustment wheel has an actuation region formed by the lateral surface, formed about the axis of rotation, of the depth adjustment wheel. This actuation region is therefore formed not on an end surface of the depth adjustment wheel but on the lateral surface thereof. In this way, the depth adjustment wheel can be directly rotated and thus actuated manually, without a tool.

According to a preferred embodiment, the depth adjustment wheel has, on its outer side, preferably on its lateral surface, a knurl that is preferably oriented along the longitudinal axis. In this way, the depth adjustment wheel can be more easily gripped and actuated using one's fingers.

Preferably, the depth adjustment device has a latching stud and latching depressions which correspond with the latching stud and are preferably arranged at regular intervals about the longitudinal axis. A "ratchet feel" can thus be generated during actuation. The operator can thus better estimate the extent to which the depth adjustment wheel has already been rotated. Every instance of latching into a further latching depression corresponds to a further change in depth by a particular distance (e.g. 0.1 mm to 0.5 mm).

In order to prevent the stop element from jointly rotating as the depth adjustment wheel is rotated, the depth adjustment device has an anti-rotation mechanism for the stop element in the carrier.

The drive device can be formed as a retraction device for retracting the movable furniture part from an open position into a closed position.

The retraction device can preferably have a carrier that is attached to the carcass rail, a retraction carriage that is movable relative to the carrier, and a retraction energy storage mechanism that is connected to the carrier and the retraction carriage.

The retraction device can also have a damper for damping the retraction movement, whereby a gentle and smooth closing is ensured.

As an alternative (or in addition) to the retraction device, the drive device is formed as an ejection device for ejecting the drawer rail from the closed position into an open position.

Preferably, the ejection device has a carrier that is attached to the carcass rail, an ejection carriage that is movable relative to the carrier, and an ejection energy storage mechanism that is connected to the carrier and the ejection carriage.

Preferably, the ejection device has a locking device for locking the ejection carriage in a locking position. Overpressing the movable furniture part into an overpressed position situated behind the closed position causes the locking device to be unlocked, and the ejection energy storage mechanism ejects the ejection carriage, together with movable furniture part, in an opening direction. The locking device can have a cardioid-shaped locking track, and a locking peg that is movable in this locking track. Other locking variants, for example in the form of the ballpoint pen principle, are however also possible.

Furthermore, preferably, in the closed position, the ejection carriage of the ejection device bears against the stop element of the depth adjustment device via the stop counterpart that is formed on the ejection carriage. If the ejection carriage, in the closed position, is situated in a particular relative position with respect to the drawer rail (and thus with respect to the furniture carcass), the relative position of the drawer rail with respect to the carcass rail can be varied by adjusting the stop element along the longitudinal axis. This in turn has the effect that the depth position of the movable furniture part and of its front panel relative to the furniture carcass is adjusted and is correspondingly settable.

In order to ensure that the driver reliably moves jointly with the ejection carriage both in an opening direction and in a closing direction, it is preferably provided that the ejection carriage has a catching lever which jointly forms the stop counterpart and which, in the closed position, engages around the driver of the stop element and holds it in positively locking fashion. When a particular open position is reached (e.g. after an opening travel of from approx. 30 mm to 120 mm), the detachable connection between the catching lever and the driver is removed again.

Protection is also sought for a piece of furniture having a furniture carcass, a movable furniture part and a pull-out guide according to the invention.

It is particularly preferable that the movable furniture part is mounted movably on the furniture carcass by two pull-out guides which are installed on opposite sides of the furniture carcass and which are preferably formed so as to be mirror-symmetrical with respect to one another.

BRIEF DESCRIPTION OF THE DRAWINGS

Further details and advantages of the present invention will be explained in more detail below on the basis of the description of the embodiments illustrated in the drawings, in which:

FIG. 17 shows the pull-out guide as per FIG. 15 in an open position, FIG. 18 shows a detail from FIG. 17, FIGS. 19-38 are different illustrations, perspectives, sections and details of a first embodiment example of the depth adjustment device.

DETAILED DESCRIPTION OF THE INVENTION

Figure 1:
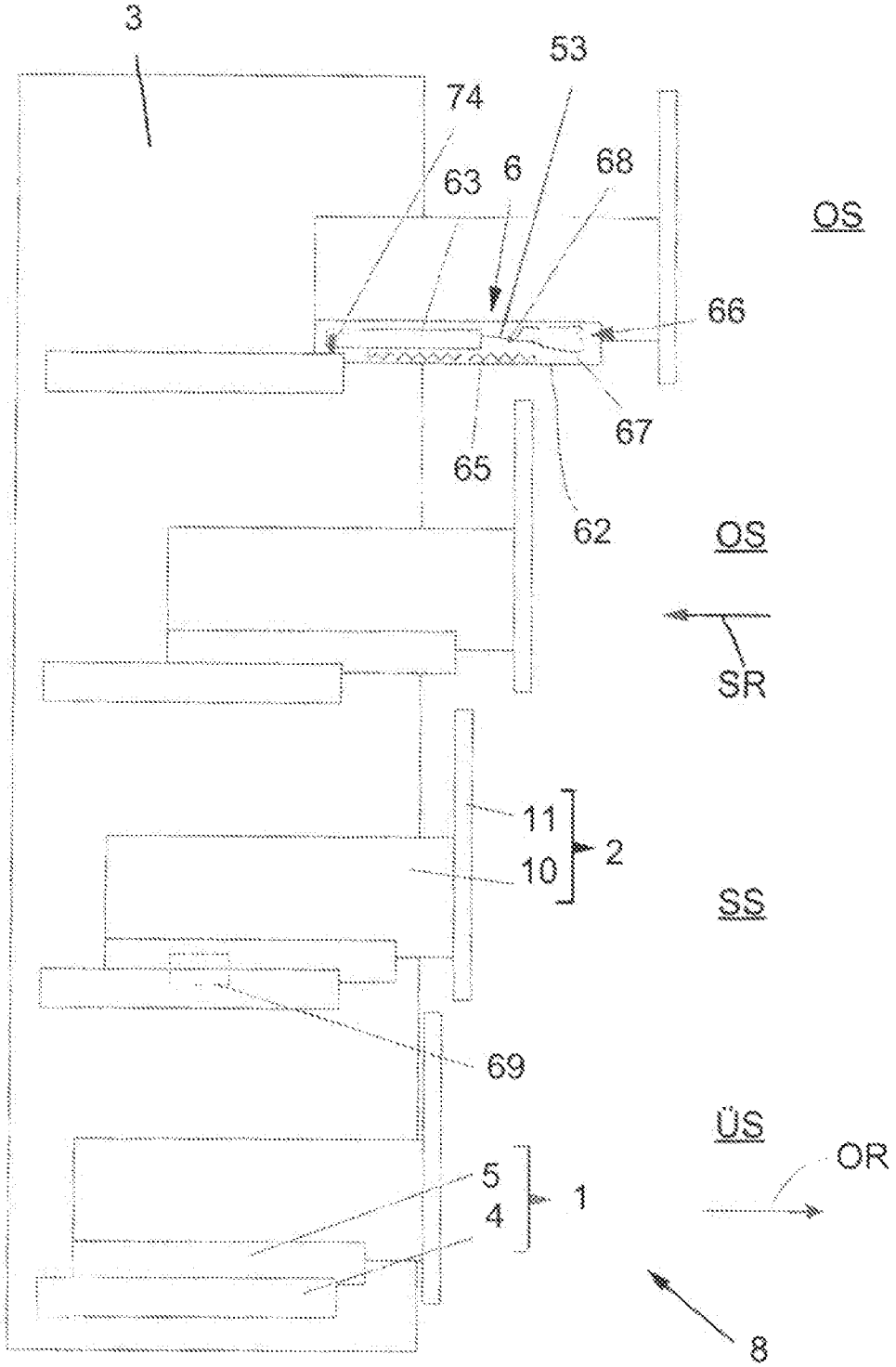
FIG. 1 schematically shows a piece of furniture with multiple movable furniture parts, arranged one above the other, in different positions.

FIG. 1 very generally illustrates a piece of furniture 8 having a furniture carcass 3 and a total of four movable furniture parts 2 in the form of drawers. Each drawer consists at least of a drawer container 10 and a front panel 11. The drawers are fastened to the furniture carcass 3 by means of a (drawer) pull-out guide 1 consisting of a drawer rail 5 and a carcass rail 4 (and optionally a middle rail, not illustrated).

A drive device 6 is schematically illustrated in the case of the uppermost drawer. The drive device 6 has a carrier 62. In this case, this carrier 62 is attached to the drawer rail 5. According to the invention, the drive device 6 is however—by contrast to FIG. 1—attached to the carcass rail 4. The drive device 6 is in this case formed as an ejection device 61, wherein the ejection carriage 63 and the ejection energy storage mechanism 65 of this ejection device 6 are schematically illustrated. The locking device 66 has a guide track 67, which is formed in the carrier 62, and the locking peg 68, which is guided in the (in this case cardioid-shaped) guide track 67. On the carcass rail 4 (or on the furniture carcass 3 itself), there is arranged a driver 74 with which the ejection device 61 engages at least in sections. According to the invention, the arrangement is however reversed: that is to say, the drive device 6 is assigned to the carcass rail 4, whereas the driver 74 is assigned to the movable furniture part 2. This uppermost drawer is situated in the open position OS.

If the drawer is moved from this open position OS in a closing direction SR, the locking peg 68 moves in a closing portion of the guide track 67.

In the process, the ejection energy storage mechanism 65 is tensioned as a result of a relative movement between ejection carriage 63 and carrier 62.

In the closed position SS (third drawer from the top), the ejection energy storage mechanism 65 has been fully tensioned. This closed position SS can be reached as a result of a purely manual closing movement. Alternatively, the drawer can be moved or retracted into the closed position SS by the retraction device 69, if present, which is merely schematically illustrated and is integrated into the pull-out guide 1.

Proceeding from this closed position SS, pressing on the drawer causes the drawer to move into the overpressed position US (lowermost drawer in FIG. 1). This causes the unlocking of the locking device 66. After the overpressing carried out in a closing direction SR, as soon as the user no longer presses on the drawer, the drawer is ejected in an opening direction OR by the drive device 6. The drawer thus moves into the open position OS as per the second drawer from the top. In this position, the drawer can be gripped for example by way of the front panel 11 and manually moved further into the position as per the first drawer from the top.

Figure 2:
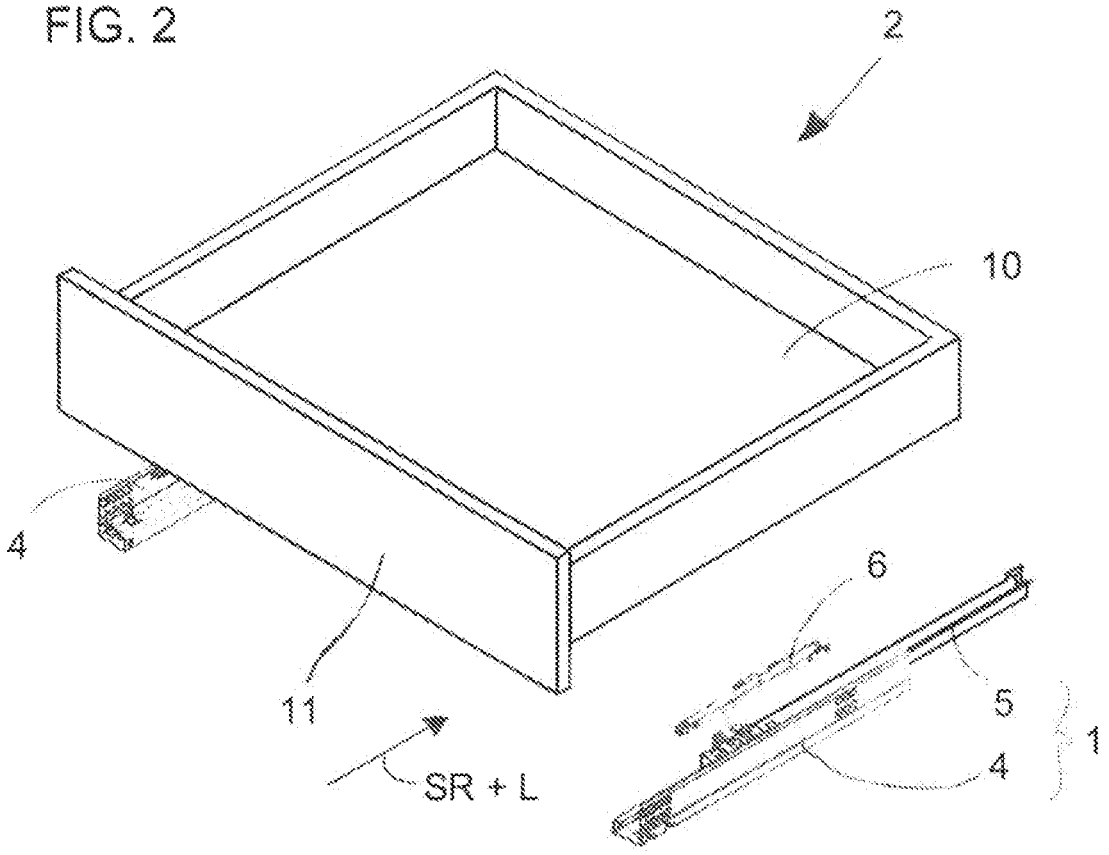
FIG. 2 is a perspective view of a movable furniture part with two pull-out guides together with drive device.

FIG. 2 is a perspective illustration of a drawer (movable furniture part 2) having a drawer container 10 and a front panel 11. Also illustrated is an arrangement composed of two pull-out guides 1 having in each case two drawer rails 5 and two carcass rails 4, wherein in each case one drawer rail 5 and one carcass rail 4 of the pull-out guide 1 are provided on both sides of the drawer. FIG. 2 furthermore shows a drive device 6. The drive device 6 is attached to the carcass rail 4. This drive device 6 (or the carrier 62 thereof) extends in the closing direction SR of the drawer. This closing direction also corresponds to the longitudinal axis L of the drawer rail 5 or of the pull-out guide 1 as a whole. In particular in the case of relatively small or relatively narrow drawers 2, it is sufficient for the drawer to be assigned only one drive device 6. The latter can (as illustrated) be assigned to the right-hand pull-out guide 1 (but also to the left-hand pull-out guide 1).

Figure 3:
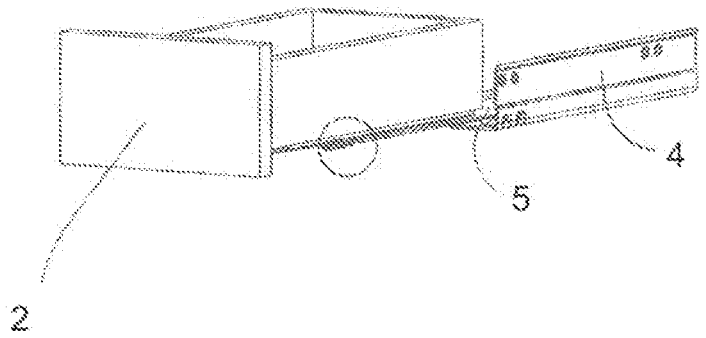
FIG. 3 is a perspective view of a movable furniture part together with pull-out guide.

FIG. 3 is a perspective illustration of a movable furniture part 2 together with drawer rail 5 and carcass rail 4. In the circle indicated, the depth adjustment device 7, which is installed on the drawer rail 5, is illustrated.

Figure 4:
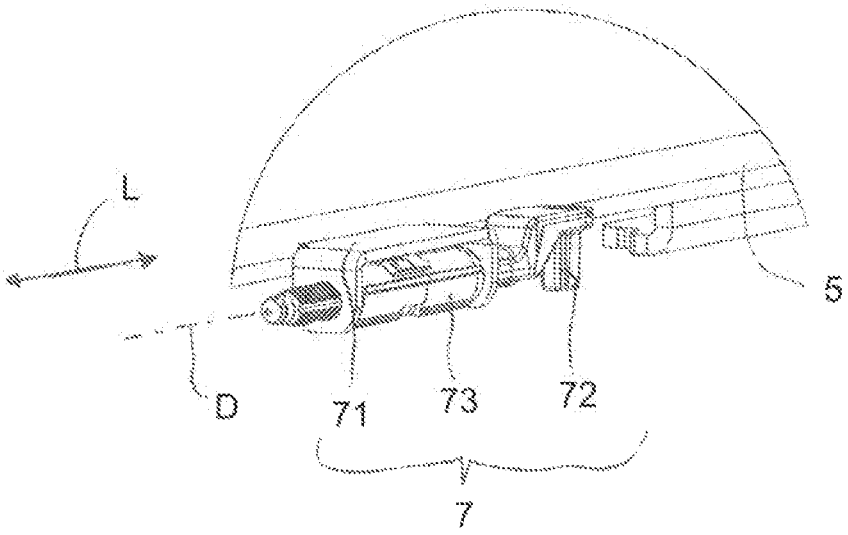
FIG. 4 shows a detail from FIG. 3.

FIG. 4 shows the detail circled in FIG. 3, on an enlarged scale. The main components of the depth adjustment device 7 can thus be seen. This depth adjustment device 7 is made up of the carrier 71, the stop element 72 and the depth adjustment wheel 73. The carrier 71 is fixedly connected to the drawer rail 5. The stop element 72 is mounted in the carrier so as to be displaceable along the longitudinal axis L. The depth adjustment wheel 73 is in turn rotatable about the axis of rotation D. As can be seen, the axis of rotation D and the longitudinal axis L are oriented parallel to one another.

FIGS. 5 to 10 illustrate the movable furniture part 2 with the pull-out guide 1 in each case from above and in each case in the closed position SS, wherein the differently set depth adjustment device 7 generates a different dimension for the front panel gap F in each case. In general, in each of said FIGS. 5 to 10, the movable furniture part 2 has been partially omitted in order to provide a view in the direction of the depth adjustment device 7 and of the drive device 6.

Figure 5:
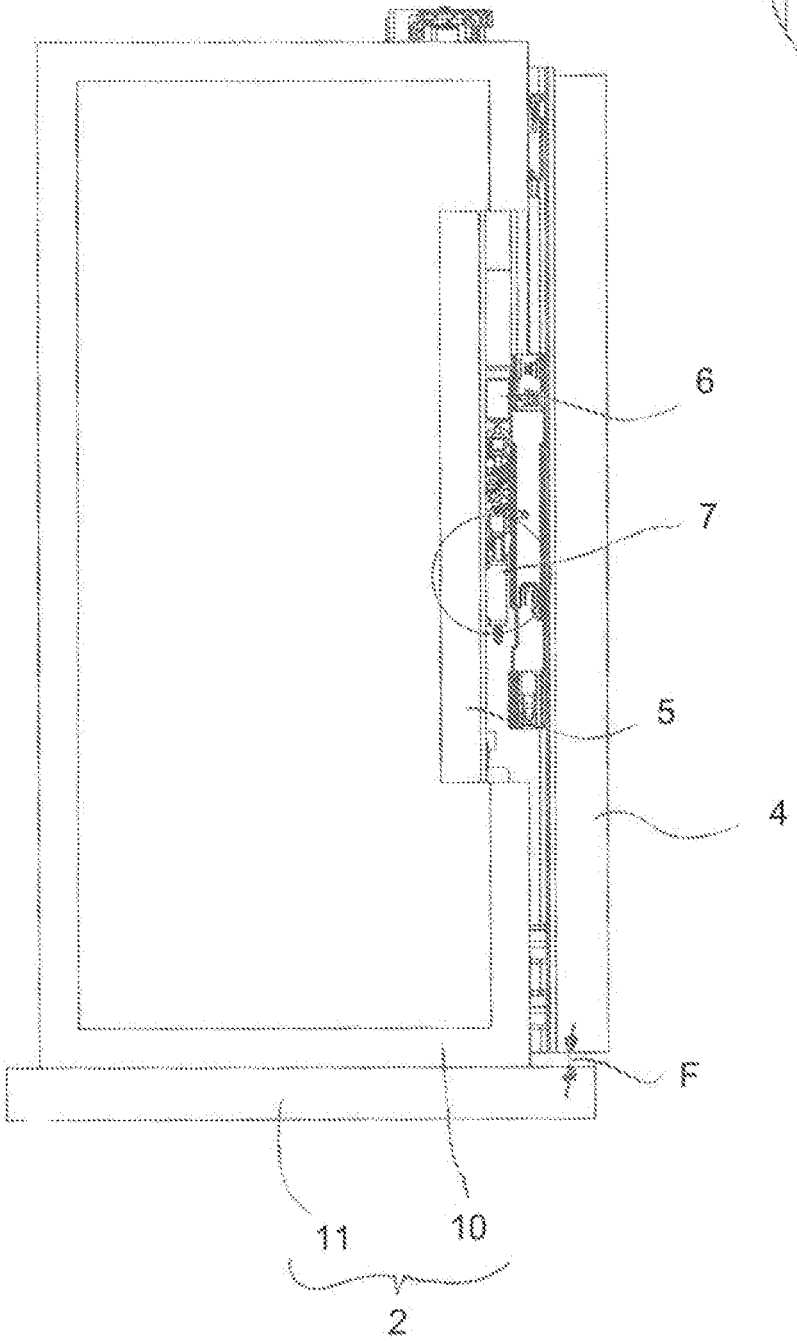
FIGS. 5-10 is a top view of the movable furniture part together with pull-out guide with the depth adjustment device in different positions in each case, and details of the depth adjustment device.
Figure 6:
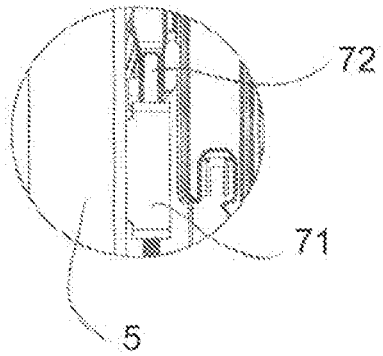

In FIG. 5, and in the detail as per FIG. 6, it can be seen that the stop element 72 has been extended to a relatively great extent relative to the carrier 71. Since the stop element 72 is bearing against the stop counterpart 60 (not visible in detail here) of the drive device, a relatively large front panel gap F is formed.

Figure 7:
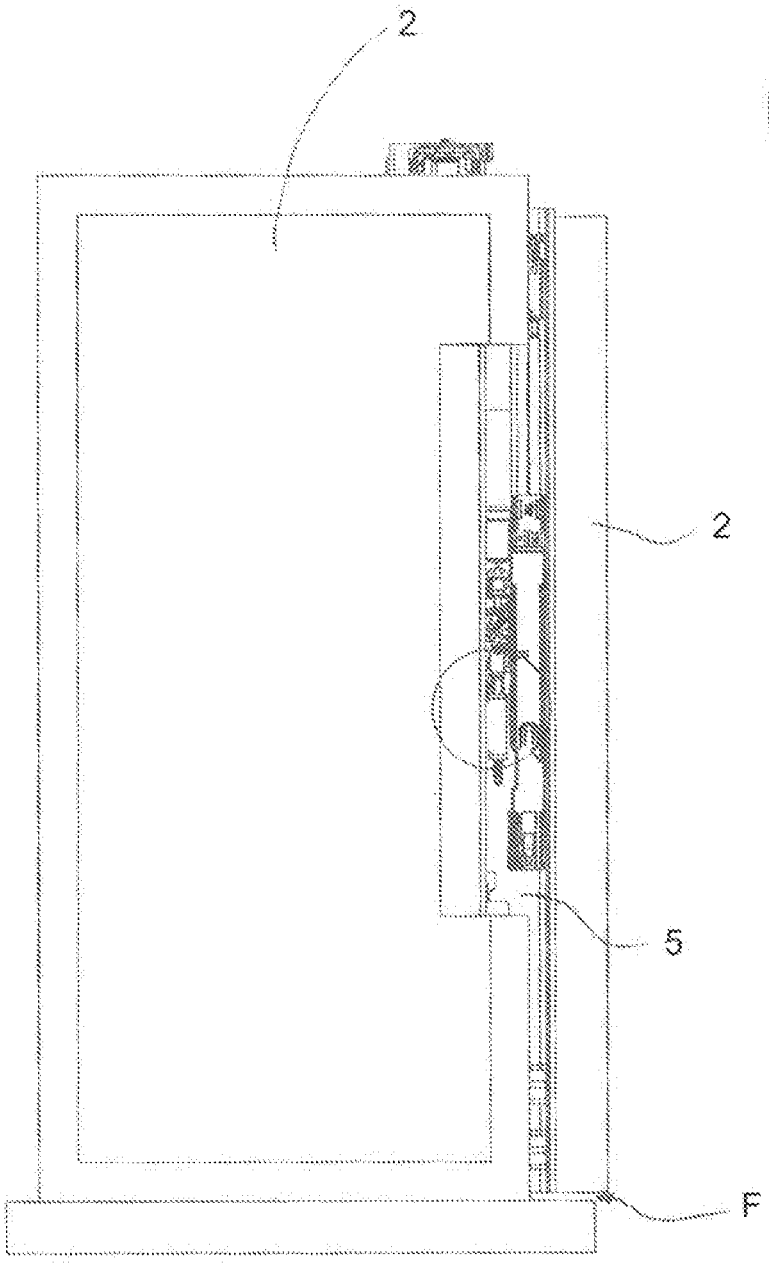
Figure 8:
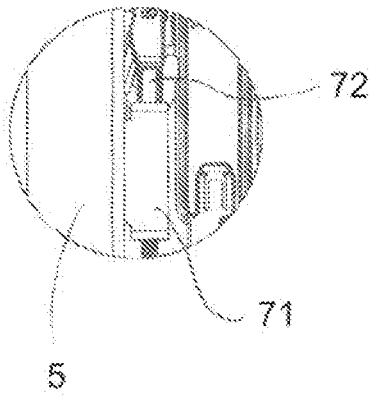

If the depth adjustment device 7 is actuated by way of the depth adjustment wheel 73, the stop element 72 is moved linearly relative to the carrier 71. In FIG. 7 and the associated detail 8, this results in a smaller front panel gap F in the closed position SS.

Figure 9:
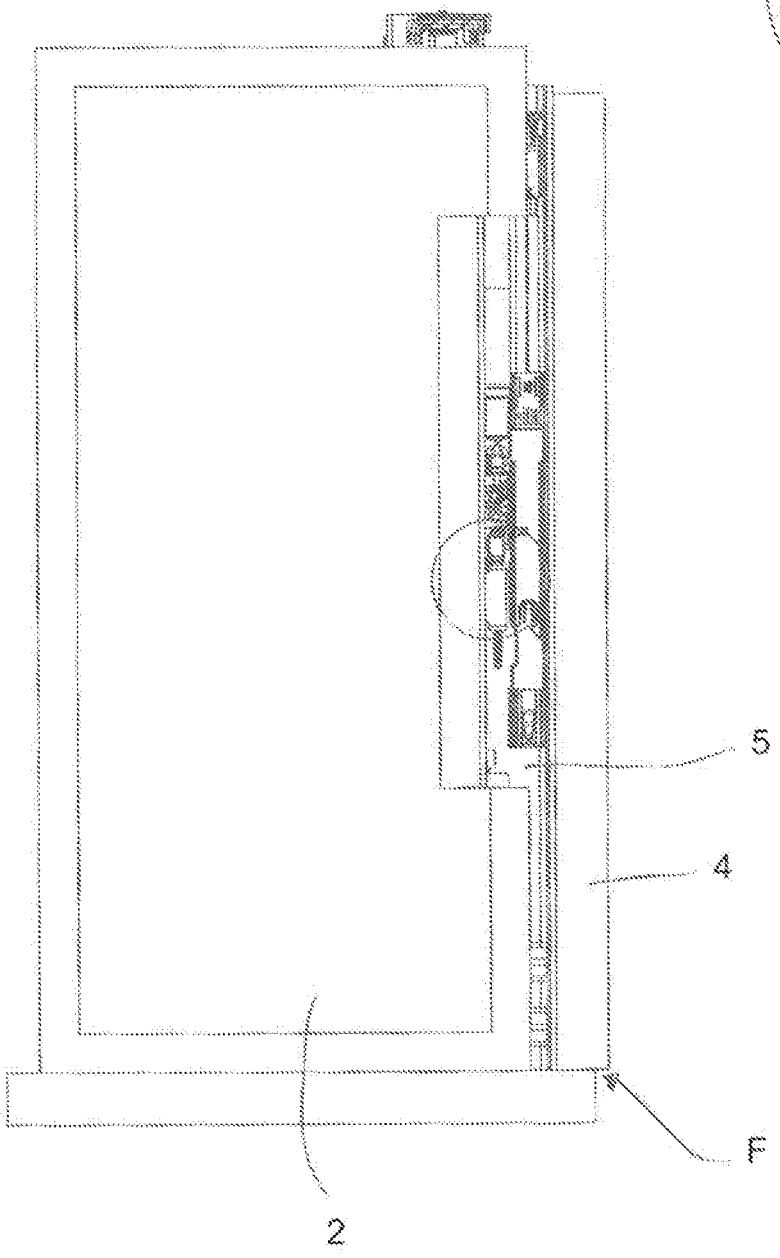
Figure 10:
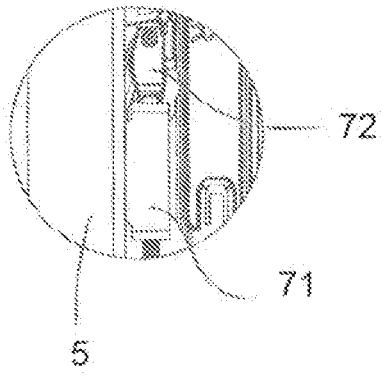

If the depth adjustment wheel 73 is rotated further in the same direction, this soon results in a position as in FIG. 9 and the associated detail as per FIG. 10. The stop element 72 has been almost completely retracted into the carrier 71. There is practically no longer a front panel gap F.

From a comparison of FIGS. 5, 7 and 9, it is also evident that there is in each case a different relative position between the carcass rail 4 and the drawer rail 5 in the closed position SS.

Figure 11:
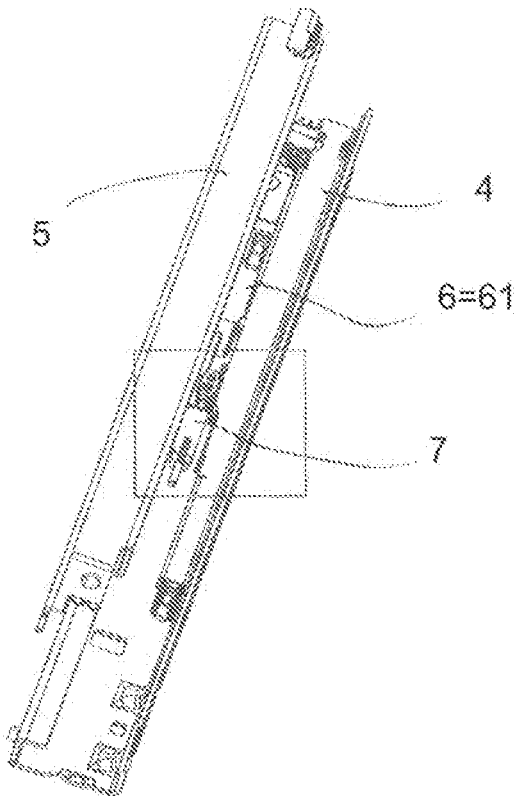
FIG. 11 is a perspective view of a pull-out guide with a first variant of the drive device.
Figure 12:
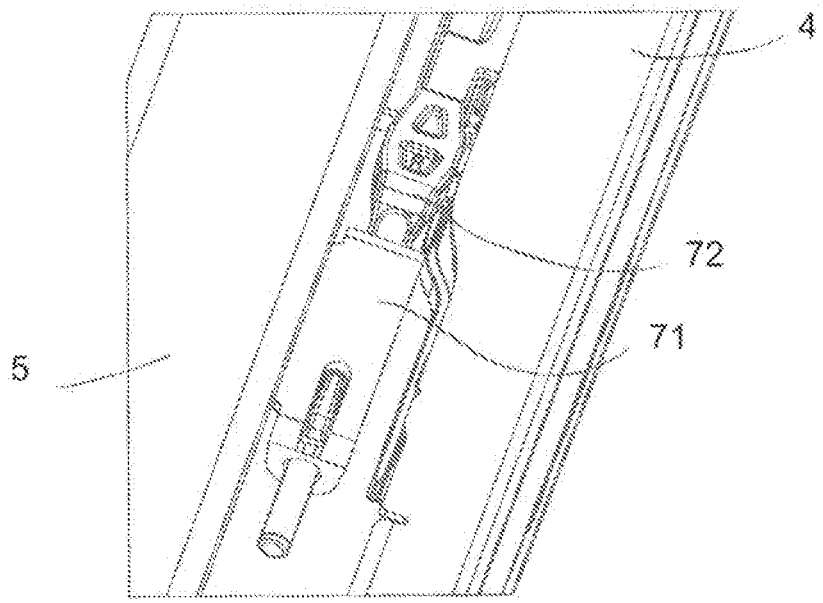
FIG. 12 shows a detail from FIG. 11.

The pull-out guide 1 is illustrated in a perspective view in FIG. 11 and the associated detail as per FIG. 12. The drive device 6 is situated between the drawer rail 5 and the carcass rail 4. The furniture fitting is thus as a whole formed relatively narrow. The furniture fitting is thus laterally delimited by the two rails 4 and 5, the drive device 6 does not protrude laterally.

Figure 13:
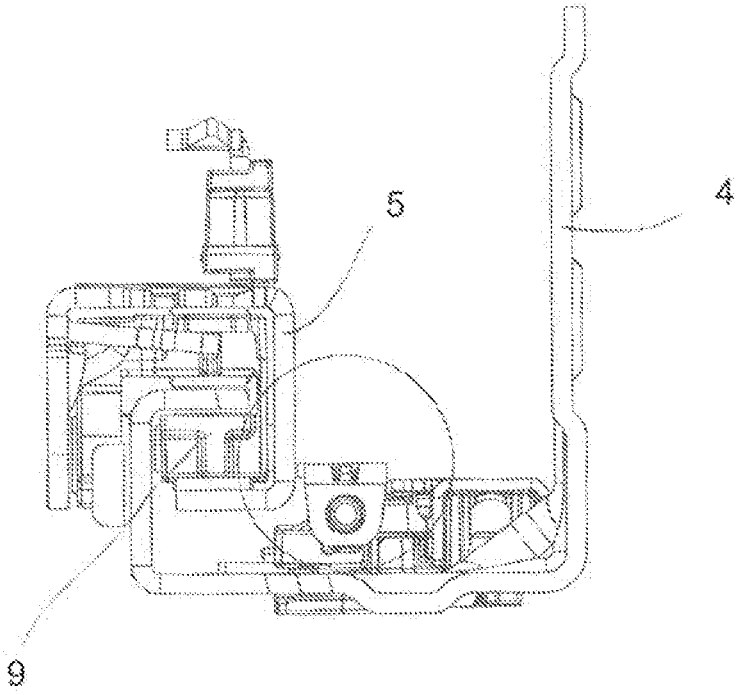
FIG. 13 shows a vertical section through the pull-out guide as per FIG. 11.
Figure 14:
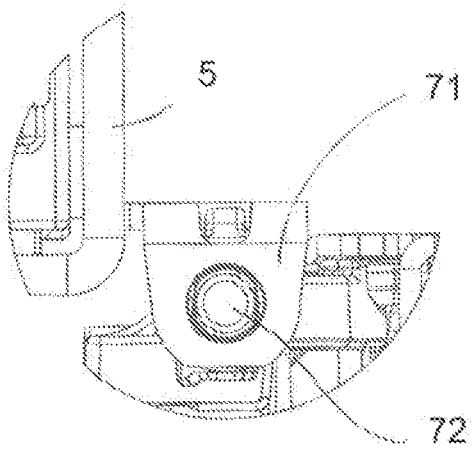
FIG. 14 shows a detail from FIG. 13.
Figure 16:
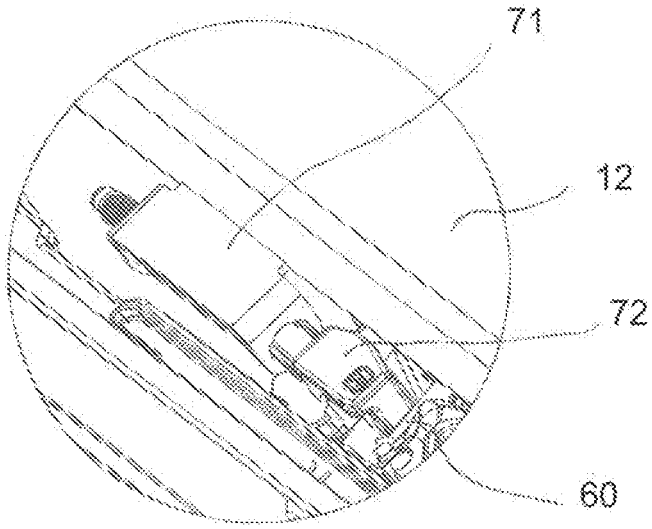
FIG. 16 shows a detail from FIG. 15.

The pull-out guide 1 is illustrated in the form of a (vertical) section in FIG. 13 and the associated detail as per FIG. 14. It can be seen that the carcass rail 4 and the drawer rail 4 are each formed as bent metal profiles. The drawer rail 5 is mounted movably on the carcass rail 4 via rollers 9. FIG. 14 shows in particular the carrier 71 and the attachment thereof to the drawer rail 5, and the stop element 72.

FIGS. 15 to 18 show a further design variant of the pull-out guide 1, in perspective and detail views. This design variant differs from the preceding one through the design of the drive device 6. In this case, the drive device 6 is formed as a retraction device 69, whereas the drive device 6 in FIG. 11 is formed as an ejection device 61 for ejecting the drawer rail 5 from the closed position SS into an open position OS.

It can also be provided that the drive device 6 combines both functions and functions both as an ejection device 61 and as a retraction device 69.

Figure 15:
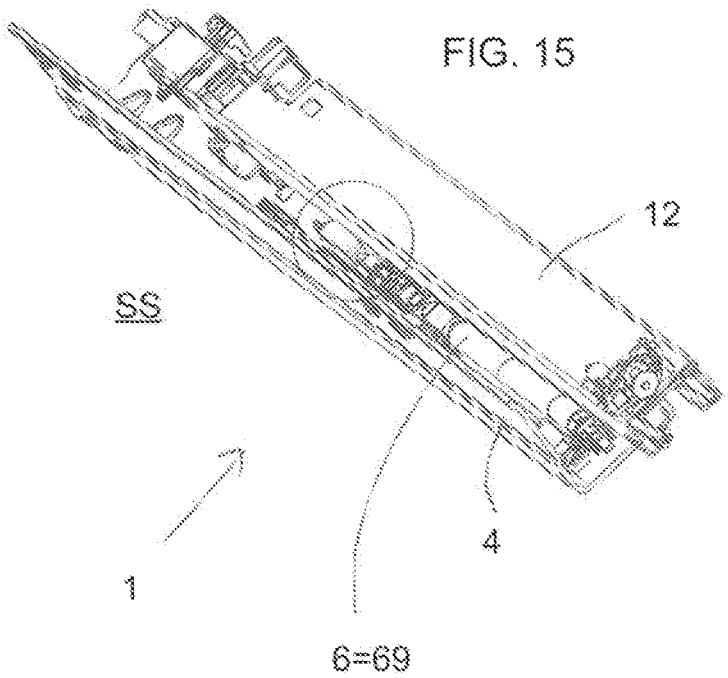
FIG. 15 is a perspective view of a pull-out guide, in the closed position, with a second variant of the drive device.

In FIG. 15, the pull-out guide 1 is in the closed position SS, whereas, in FIG. 17, the pull-out guide is illustrated in an open position OS. In the closed position SS, the stop element 72 bears against the stop counterpart 60 of the drive device 6 (see circled detail from FIG. 15 in FIG. 16). By contrast, in FIG. 17, the stop element 72 is spaced apart, and thus detached, from the stop counterpart 60.

Said stop counterpart 60 can be formed on a catching lever. The catching lever, in the closed position SS, engages around the driver 74 of the stop element 72 and holds it in positively locking fashion. During a movement in the opening direction OR, the positively locking connection is removed by pivoting the catching lever.

FIGS. 15 to 18 each illustrate the so-called drawer rail 12. This serves as a connecting device for connecting the drawer container 10 to the drawer rail 5.

FIGS. 19 to 38 show a first embodiment example of a depth adjustment device 7 in different illustrations, perspectives, (partial) sections and details.

Figure 19:
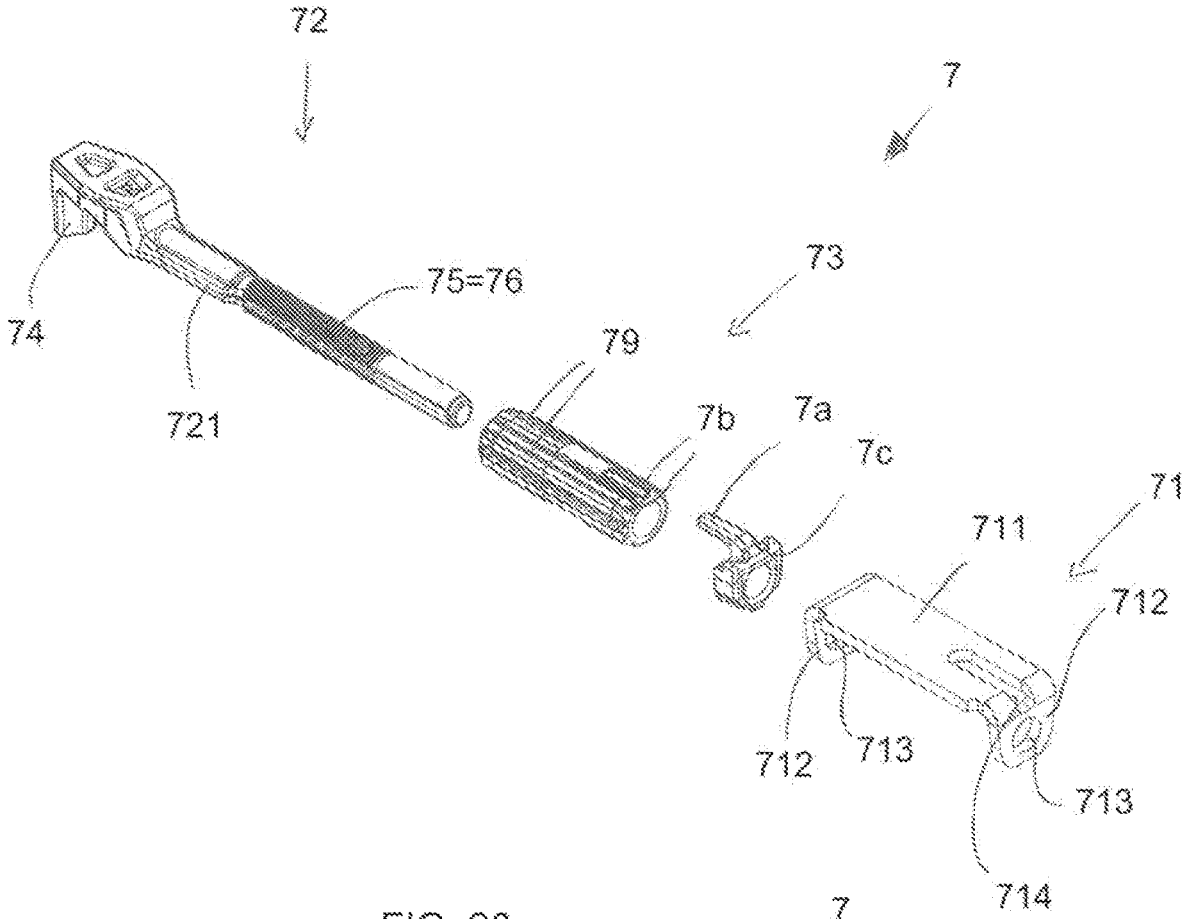

FIG. 19 shows the components of the depth adjustment device 7 in an exploded illustration.

The carrier 71 is formed as a preferably metallic bent bracket. This carrier 71 has a base region 711 and two holding lugs 712, with guide openings 713 respectively formed therein, which protrude substantially at right angles from the base region 711. In addition, an opening 714 for the arresting element **7*c* is formed in the carrier 71**.

The stop element 72 is mounted in the guide openings 713 so as to be displaceable along the longitudinal axis L. The stop element 72 has a bolt-shaped driver 74 and a movement transmission region 75. The movement transmission region 75 is formed as an external thread 76 extending in spiral fashion about the axis of rotation D.

Between the driver 74 and this external thread 76, the stop element 72 has lateral projections 721. These projections 721, together with corresponding depressions in the region of the guide opening 713, form an anti-rotation mechanism for the stop element 72 in the carrier 71, with the result that the stop element 72 cannot rotate about the axis of rotation D.

The depth adjustment wheel 73 is, at least in regions, formed in the manner of a sleeve about the axis of rotation D, and has an elongate opening with an internal thread 77 extending in spiral fashion about the axis of rotation D. This internal thread 77 corresponds with the external thread 76 of the movement transmission region 75 of the stop element 72. On its outer side—specifically on its lateral surface—the depth adjustment wheel has a knurl 79. This knurl 79 is formed lamellar or rib-shaped, wherein the lamellae or ribs extend along the longitudinal axis L.

Latching depressions **7*b* are formed on the depth adjustment wheel 73 (which latching depressions correspond to the "lamella troughs"). These latching depressions 7*b* correspond with the latching stud 7*a* of the arresting element 7*c*. When the depth adjustment wheel 73 is rotated, a "ratchet feel" is generated by means of this latching stud 7*a*. In addition, the depth adjustment wheel 72 is held in its position by the arresting element 7*c*, with the result that, in the event of vibrations, said depth adjustment wheel cannot rotate of its own accord about the stop element 72** and thus cause an undesired adjustment of the depth position or of the front panel gap F.

Figure 20:
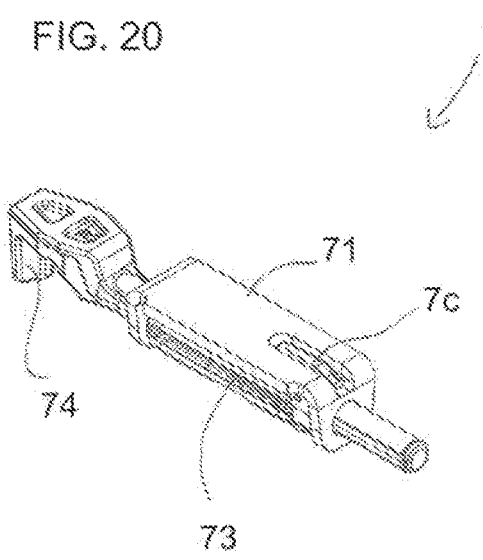

FIG. 20 illustrates the depth adjustment device in the assembled state. The stop element 72 is led through the two guide openings 713, and the depth adjustment wheel 73 is mounted rotatably on the stop element 72, wherein a movement of the depth adjustment wheel 73 along the longitudinal axis L is prevented by the holding lugs 712 of the carrier 71.

Figure 21:
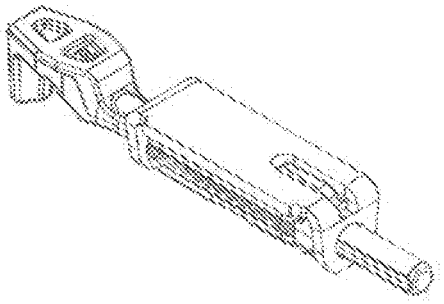

FIG. 21 shows the same illustration as FIG. 20 once again.

Figure 22:
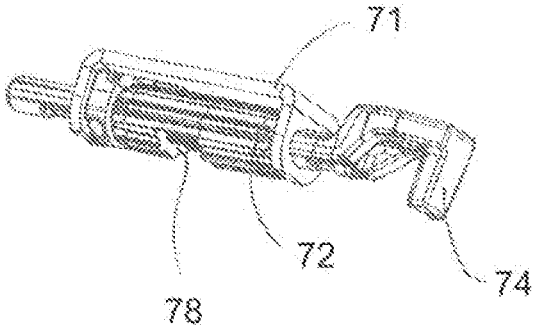

FIG. 22 provides a clearer view of the depth adjustment wheel 73. It can be seen that the depth adjustment wheel 73 has a recess 78. This is advantageous for the production of the depth adjustment wheel 73, and of the internal thread 77 thereof, in a plastics injection-molding process.

Figure 23:
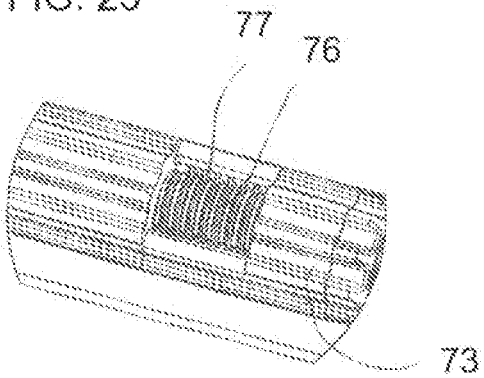

FIG. 23 shows a view through this recess 78 of the depth adjustment wheel 23, wherein a small part of the internal thread 77 and a larger region of the external thread 76 are visible. The knurl 79 on the lateral surface of the depth adjustment wheel 23 can also be clearly seen.

Figure 24:
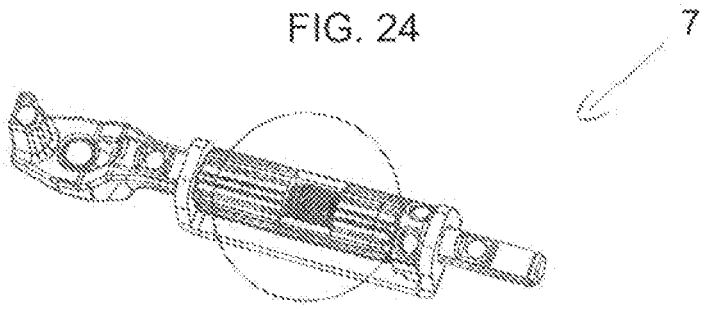

The detail as per FIG. 23 originates from the perspective illustration of the depth adjustment device 7 of FIG. 24.

Figure 25:
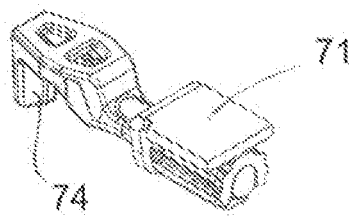
Figure 26:
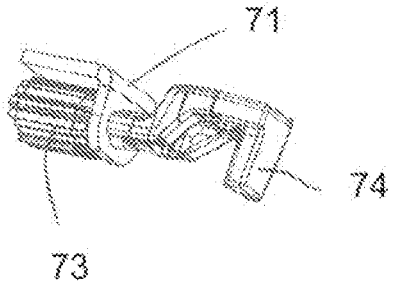

FIGS. 25 and 26 show the depth adjustment device 7, truncated in the center, from different perspectives.

Figure 27:
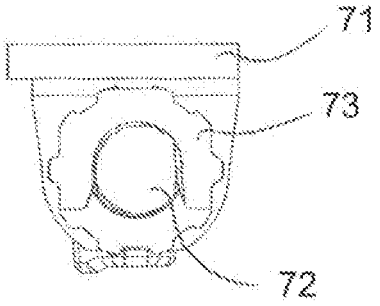

It can be seen in FIG. 27 that the stop element 72 is flattened on one side in the region of the external thread 76. In this way, the rotational movement of the depth adjustment wheel 73 on the external thread 76 is smoother, because there is less friction.

Figure 28:
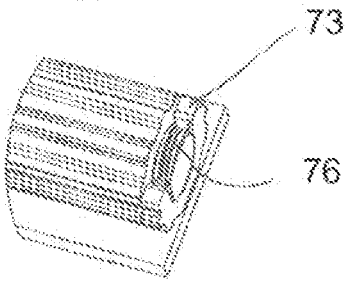
Figure 29:
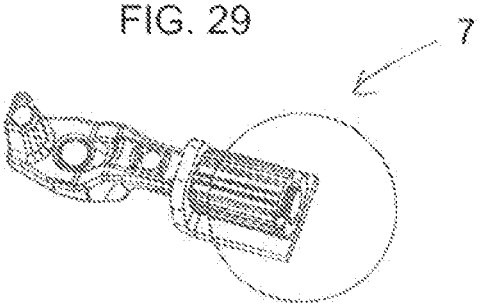
Figure 30:
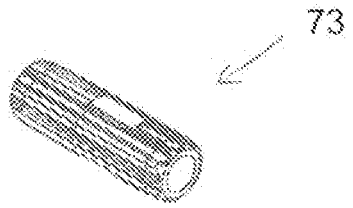
Figure 32:
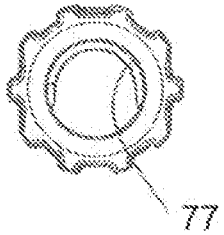
Figure 31:
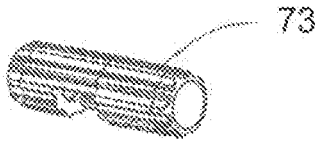
Figure 33:
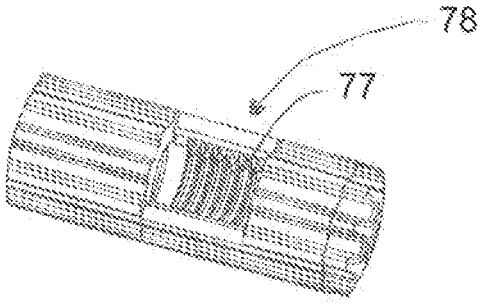
Figure 34:
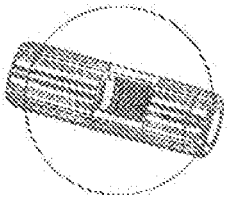

FIG. 28 shows a detail, pertaining to FIG. 29, of the depth adjustment device 7.

FIGS. 30 to 34 illustrate the depth adjustment wheel 73 in different perspectives. In the front view as per FIG. 32, it can be seen that the thread elevations of the internal thread 77 protrude in the direction of the axis of rotation D from the rest of the inner surface of the depth adjustment wheel 73. A relatively frictionless rotational movement is thus possible. It can be seen in FIGS. 33 and 34 that the internal thread 77 is formed not over the full circumference but only over half of the circumference of the inner surface of the depth adjustment wheel 73. The recess 78 is situated radially opposite this internal thread 77.

Figure 36:
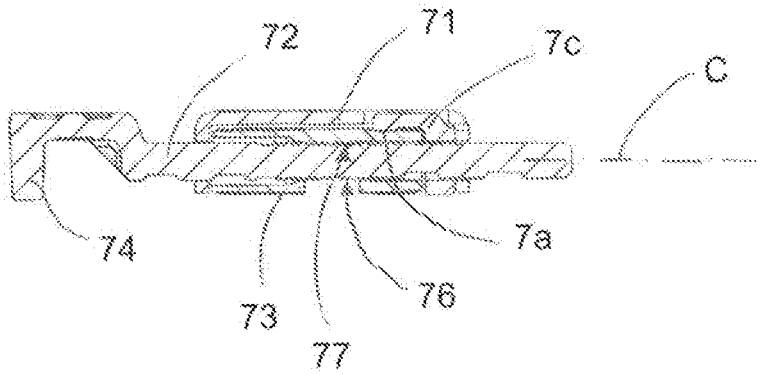
Figure 35:
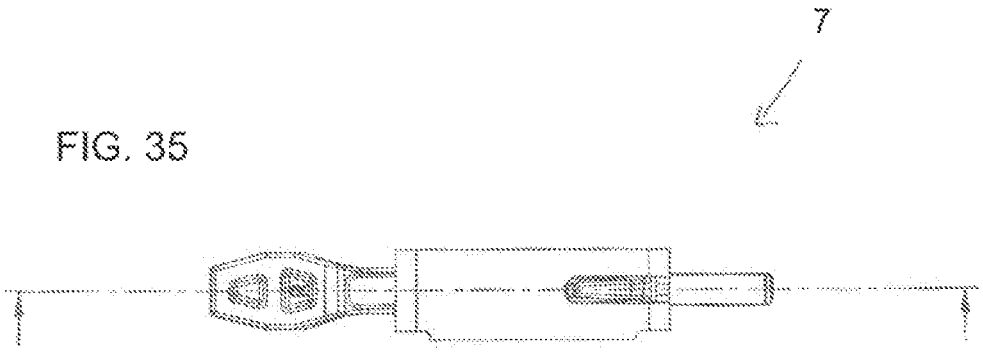

FIG. 35 indicates a section through the depth adjustment device 7 that is illustrated in FIG. 36. The internal thread 77 and the corresponding external thread 76 can be clearly seen. The arresting element 7*c* with its latching stud 7*a*, the bolt-shaped driver 74 and the carrier 71 can also be seen.

Figure 38:
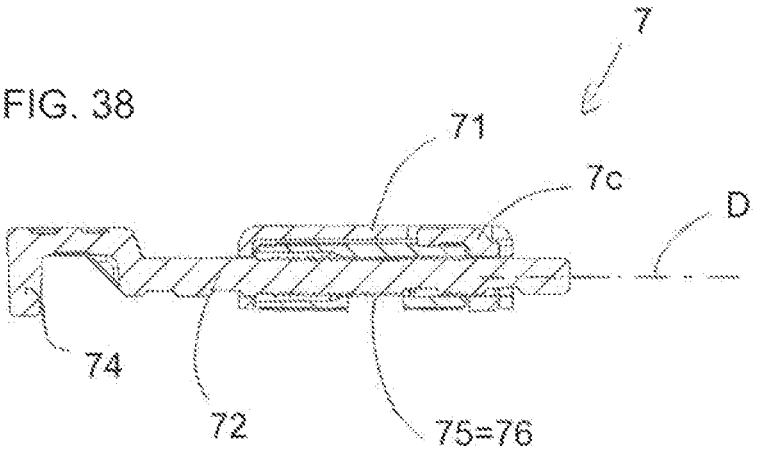
Figure 37:
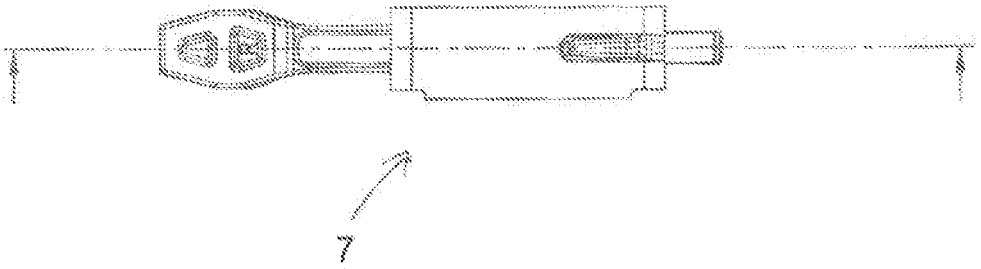

Rotating the adjustment wheel 73 about the axis of rotation D causes the depth adjustment device 7 to move into the position as per FIGS. 37 and 38.

Figure 39:
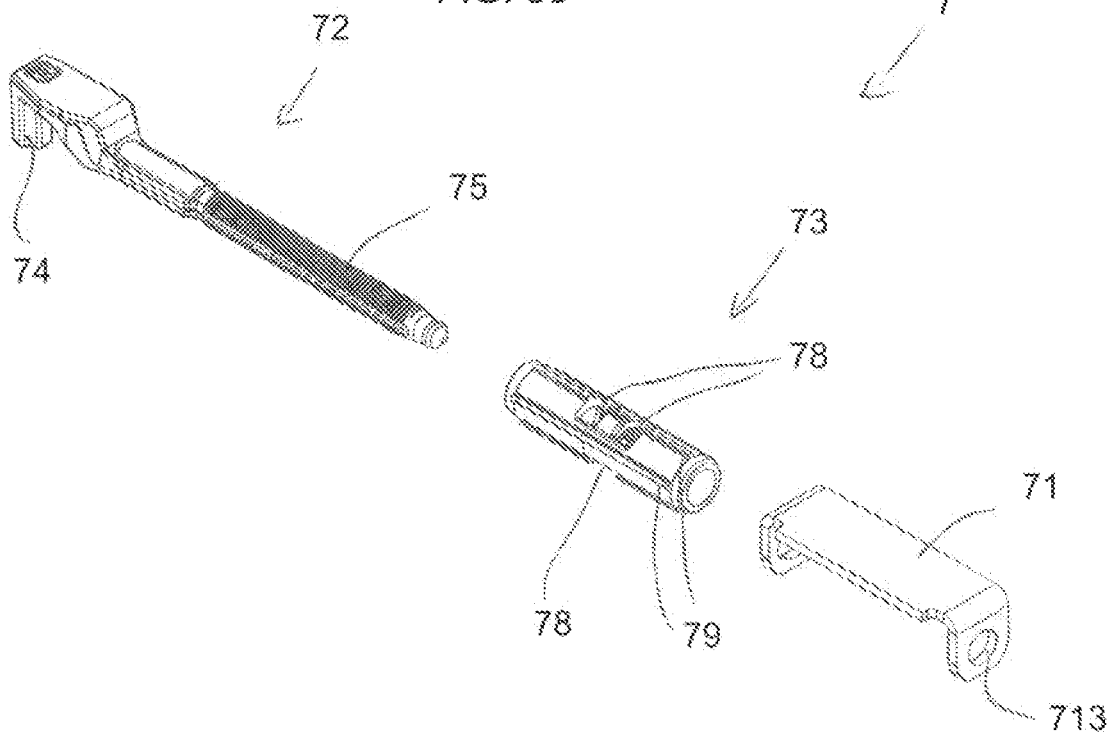
FIGS. 39-45 are different illustrations, perspectives, sections and details of a second embodiment example of the depth adjustment device.

FIG. 39 shows a further embodiment example of a depth adjustment device 7. The stop element 72 together with driver 74 and movement transmission region 75 is formed practically identically to that in the preceding embodiment example. Differences exist in the depth adjustment wheel 73, which has fewer lamellar knurls 79. Instead, this depth adjustment wheel 73 however has more, specifically three, recesses 78.

Figure 40:
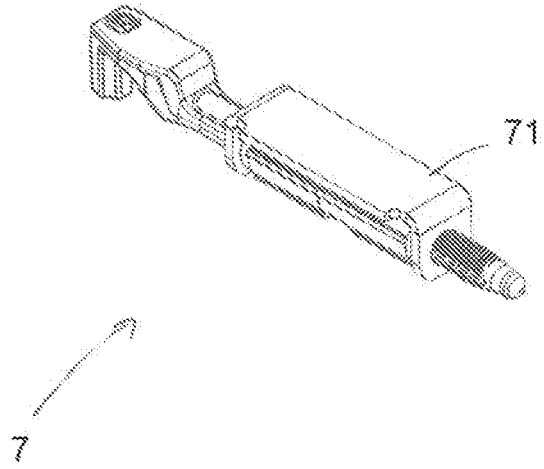

FIG. 40 illustrates the depth adjustment device 7 as per FIG. 39 in the assembled state.

Figure 43:
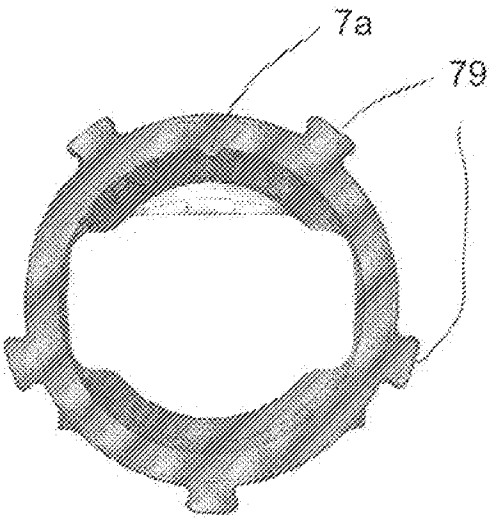
Figure 41:
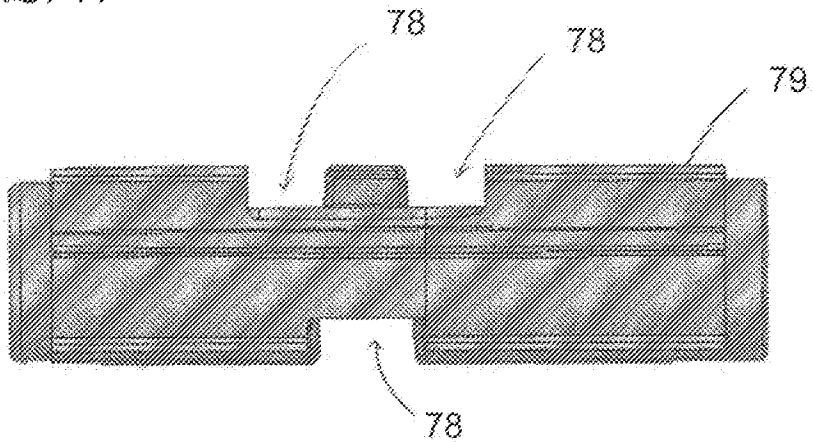
Figure 42:
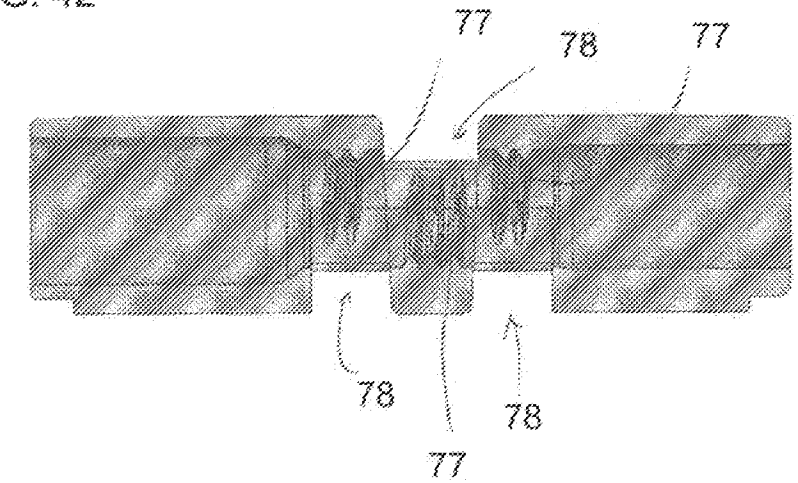

FIGS. 41 to 43 illustrate the depth adjustment wheel 73 in different perspectives. The recesses 78 can be clearly seen in FIG. 41.

FIG. 42 shows a half-cutaway top view of a depth adjustment wheel 73. This provides a view of the three separate internal threads 77, which are arranged radially opposite a respective recess 78.

In the section as per FIG. 43, it is possible to see the latching stud 7*a*, which in this case is formed directly on the depth adjustment wheel 73.

Figure 45:
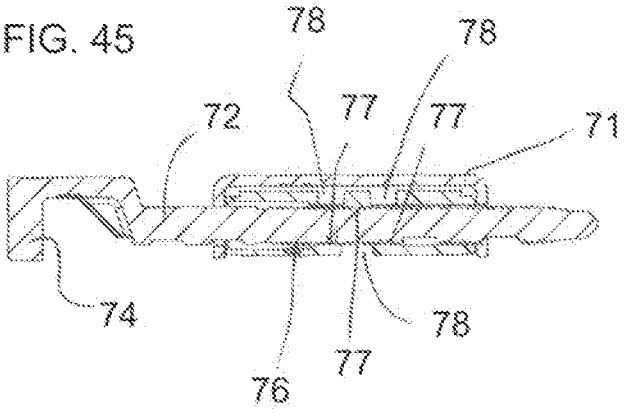
Figure 44:
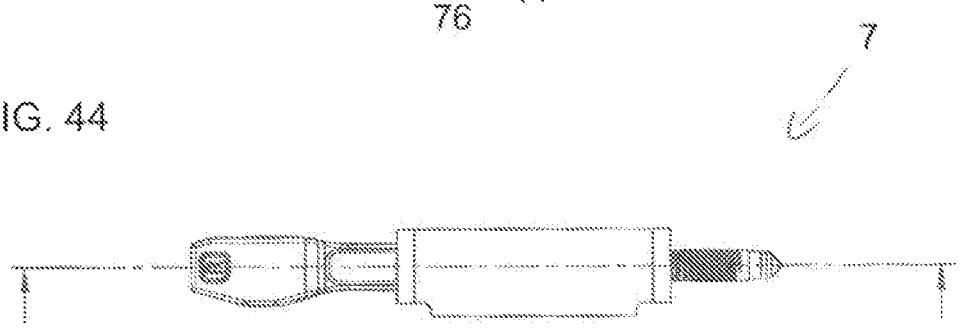
Figure 46:
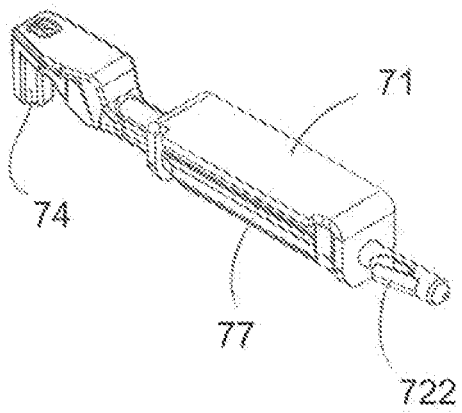
FIGS. 46-49 are different illustrations, perspectives and details of a third embodiment example of the depth adjustment device.
Figure 47:
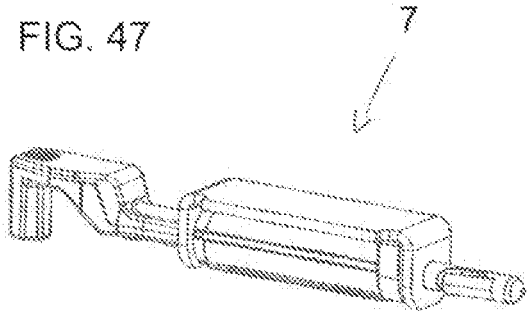

The section indicated in FIG. 44 is illustrated in FIG. 45. The three internal threads 77, which are formed in the shape of half-shells, are arranged opposite the respective recesses 78 and correspond with the external thread 76 of the stop element 72.

FIGS. 46 to 49 show a third embodiment example of the depth adjustment device 7. By contrast to the preceding embodiment examples, a spreading element 722 is arranged at that end of the stop element 72 which is remote from the driver. This prevents the stop element 72 from being able to be completely unscrewed from the carrier 71 and the depth adjustment wheel 73.

Figure 48:
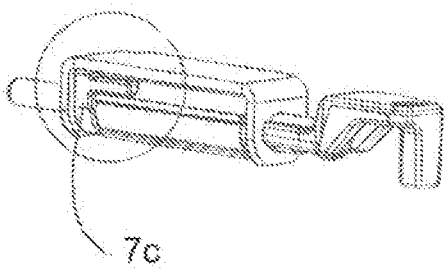
Figure 49:
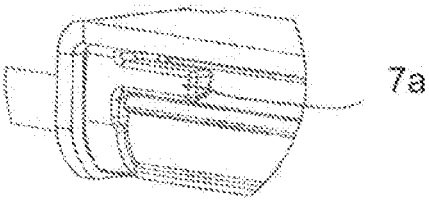

FIG. 48 shows the different design of the arresting element 7*c*. In the detail as per FIG. 49, the latching stud 7*a* is held between the lamellar knurls 79 on the lateral surface of the depth adjustment wheel 73.

LIST OF REFERENCE NUMBERS

1 Pull-out guide
2 Movable furniture part
3 Furniture carcass
4 Carcass rail
5 Drawer rail
6 Drive device
60 Stop counterpart
61 Ejection device
62 Carrier
63 Ejection carriage
65 Ejection energy storage mechanism
66 Locking device
67 Guide track
68 Locking peg
69 Retraction device
7 Depth adjustment device
71 Carrier
711 Base region
712 Holding lugs
713 Guide openings
714 Opening
72 Stop element
721 Projections
722 Spreading element
73 Depth adjustment wheel
74 Driver
75 Movement transmission region
76 External thread
77 Internal thread
78 Recess
79 Knurl
7*a* Latching stud
7*b* Latching depressions
7*c* Arresting element
8 Piece of furniture
10 Drawer container
11 Front panel
12 Drawer rail
L Longitudinal axis
OR Opening direction
SR Closing direction
OS Open position
SS Closed position
US Overpressed position
D Axis of rotation
F Front panel gap

The invention claimed is:

1. A pull-out guide for a furniture part that is movable relative to a furniture carcass, the pull-out guide comprising:

a carcass rail to be connected to the furniture carcass;

a drawer rail mounted movably on the carcass rail and connectable to the movable furniture part and having a longitudinal axis, wherein the drawer rail is movable along the longitudinal axis in an opening and closing direction of the movable furniture part;

a drive device configured to move the drawer rail and the movable furniture part connectable thereto at least in a partial range of travel between a closed position and an open position; and a depth adjustment device configured to adjust the closed position of the drawer rail relative to the carcass rail, wherein the depth adjustment device includes a carrier, a stop element movable relative to the carrier along the longitudinal axis, and a depth adjustment wheel mounted on the carrier so as to be rotatable about an axis of rotation so as to move the stop element along the longitudinal axis, wherein the axis of rotation of the depth adjustment wheel is oriented parallel to the longitudinal axis, wherein the drive device is installed on the carcass rail, wherein the carrier of the depth adjustment device is installed on the drawer rail, and wherein the stop element bears against a stop counterpart of the drive device in the closed position, and, during the travel from the closed position into the open position, is separable from the stop counterpart.

2. The pull-out guide according to claim 1, wherein the stop element has a driver and a movement transmission region connected to the depth adjustment wheel.

3. The pull-out guide according to claim 2, wherein the driver extends at right angles with respect to the longitudinal axis and in a vertical direction when in a fitted state in the furniture carcass.

4. The pull-out guide according to claim 2, wherein the movement transmission region is formed as an external thread extending in spiral fashion about the axis of rotation.

5. The pull-out guide according to claim 1, wherein the depth adjustment wheel is at least partially formed as a sleeve about the axis of rotation.

6. The pull-out guide according to claim 4, wherein the depth adjustment wheel has an internal thread extending in spiral fashion about the axis of rotation, wherein the internal thread corresponds to the external thread of the movement transmission region.

7. The pull-out guide according to claim 6, wherein the internal thread is formed on an inner surface of the depth adjustment wheel, the inner surface covering an angle of at most 180° about the axis of rotation and the depth adjustment wheel has a recess situated radially opposite the inner surface in a region of the internal thread.

8. The pull-out guide according to claim 1, wherein the depth adjustment wheel has an actuation region formed by a lateral surface of the depth adjustment wheel, the lateral surface being formed about the axis of rotation.

9. The pull-out guide according to claim 1, wherein the depth adjustment wheel has an outer side with a knurl thereon.

10. The pull-out guide according to claim 1, wherein the depth adjustment device has a latching stud and latching depressions corresponding to the latching stud.

11. The pull-out guide according to claim 1, wherein the depth adjustment device has an anti-rotation mechanism for the stop element in the carrier.

12. The pull-out guide according to claim 1, wherein the drive device is an ejection device configured to eject the drawer rail from the closed position into the open position.

13. The pull-out guide according to claim 12, wherein the ejection device includes a carrier attached to the carcass rail, an ejection carriage movable relative to the carrier, and an ejection energy storage mechanism connected to the carrier and the ejection carriage.

14. The pull-out guide according to claim 13, wherein, in the closed position, the ejection carriage of the ejection device bears against the stop element of the depth adjustment device via the stop counterpart formed on the ejection carriage.

15. The pull-out guide according to claim 14, wherein the ejection carriage has a catching lever jointly forming the stop counterpart, and the catching lever engages around the driver of the stop element and holds the driver in a positively locking fashion in the closed position.

16. A piece of furniture comprising a furniture carcass, a movable furniture part, and the pull-out guide according to claim 1.

17. The piece of furniture according to claim 16, wherein the movable furniture part is mounted movably on the furniture carcass by two pull-out guides installed on opposite sides of the furniture carcass.

18. The pull-out guide according to claim 2, wherein the driver is bolt-shaped.

19. The pull-out guide according to claim 9, wherein the knurl is formed on a lateral outer surface of the depth adjustment wheel, and is oriented along the longitudinal axis.

20. The pull-out guide according to claim 10, wherein the latching depressions are arranged at regular intervals about the longitudinal axis.

21. The piece of furniture according to claim 17, wherein the two pull-out guides are mirror-symmetrical with respect to one another.

* * * * *